US007018758B2

(12) United States Patent
Tong et al.

(10) Patent No.: US 7,018,758 B2
(45) Date of Patent: Mar. 28, 2006

(54) PHOTOCONDUCTIVE IMAGING MEMBERS

(75) Inventors: Yuhua Tong, Webster, NY (US); Jin Wu, Webster, NY (US); Linda L. Ferrarese, Rochester, NY (US); Liang-Bih Lin, Webster, NY (US); John F. Yanus, Webster, NY (US)

(73) Assignee: Xerox Corporation, Stamford, CT (US)

( * ) Notice: Subject to any disclaimer, the term of this patent is extended or adjusted under 35 U.S.C. 154(b) by 200 days.

(21) Appl. No.: 10/664,710

(22) Filed: Sep. 17, 2003

(65) Prior Publication Data

US 2005/0058919 A1 Mar. 17, 2005

(51) Int. Cl.
*G03G 15/14* (2006.01)

(52) U.S. Cl. ..... 430/64; 430/58.8; 430/59.5

(58) Field of Classification Search ..... 430/64, 430/58.8, 59.5
See application file for complete search history.

(56) References Cited

U.S. PATENT DOCUMENTS

| | | | | |
|---|---|---|---|---|
| 3,121,006 | A | 2/1964 | Middleton et al. | 96/1 |
| 4,265,990 | A | 5/1981 | Stolka et al. | 430/59 |
| 4,464,450 | A * | 8/1984 | Teuscher | 430/58.8 |
| 4,587,189 | A | 5/1986 | Hor et al. | 430/59 |
| 4,921,769 | A | 5/1990 | Yuh et al. | 430/64 |
| 5,288,574 | A * | 2/1994 | Desilets et al. | 430/59.5 |
| 5,460,911 | A * | 10/1995 | Yu et al. | 430/64 |
| 5,473,064 | A | 12/1995 | Mayo et al. | 540/141 |
| 5,482,811 | A | 1/1996 | Keoshkerian et al. | 430/135 |
| 5,521,043 | A | 5/1996 | Listigovers et al. | 430/59 |
| 6,015,645 | A | 1/2000 | Murti et al. | 430/59 |
| 6,074,791 | A * | 6/2000 | Jennings et al. | 430/58.8 |
| 6,156,468 | A | 12/2000 | Wehelie et al. | 430/65 |
| 6,177,219 | B1 | 1/2001 | Yuh et al. | 430/65 |
| 6,218,062 | B1 * | 4/2001 | Yuh et al. | 430/59.1 |
| 6,255,027 | B1 | 7/2001 | Wehelie et al. | 430/65 |
| 6,287,737 | B1 | 9/2001 | Ong et al. | 430/58.8 |

* cited by examiner

*Primary Examiner*—Mark A. Chapman
(74) *Attorney, Agent, or Firm*—Eugene O. Palazzo; Fay, Sharpe, Fagan, Minnich & McKee, LLP

(57) ABSTRACT

A photoconductive imaging member comprised of a hole blocking layer, a photogenerating layer, and a charge transport layer, and wherein the hole blocking layer is generated from a solution of a metal alkyloxide, an amino alkylsilane, an aminoalkoxy silane or an aminoalkyl alkoxy silane, a polymer binder, and an organic solvent.

31 Claims, No Drawings

PHOTOCONDUCTIVE IMAGING MEMBERS

CROSS-REFERENCE TO RELATED APPLICATIONS

Illustrated in copending U.S. Ser. No. 10/369,816 entitled Photoconductive Imaging Members, filed Feb. 19, 2003, the disclosure of which is totally incorporated herein by reference, is a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

There is illustrated in copending U.S. Ser. No. 10/370,186, entitled Photoconductive Imaging Members, filed Feb. 19, 2003, the disclosure of which is totally incorporated herein by reference, a photoconductive imaging member comprised of a supporting substrate, a hole blocking layer thereover, a crosslinked photogenerating layer and a charge transport layer, and wherein the photogenerating layer is comprised of a photogenerating component and a vinyl chloride, allyl glycidyl ether, hydroxy containing polymer.

RELATED PATENTS

Illustrated in U.S. Pat. No. 6,015,645, the disclosure of which is totally incorporated herein by reference, is a photoconductive imaging member comprised of a supporting substrate, a hole blocking layer, an optional adhesive layer, a photogenerator layer, and a charge transport layer, and wherein the blocking layer is comprised, for example, of a polyhaloalkylstyrene.

Illustrated in U.S. Pat. No. 6,287,737, the disclosure of which is totally incorporated herein by reference, is a photoconductive imaging member comprised of a supporting substrate, a hole blocking layer thereover, a photogenerating layer and a charge transport layer, and wherein the hole blocking layer is comprised of a crosslinked polymer derived from the reaction of a silyl-functionalized hydroxyalkyl polymer of Formula (I) with an organosilane of Formula (II) and water

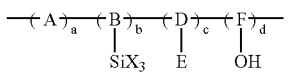

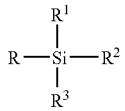

wherein A, B, D, and F represent the segments of the polymer backbone; E is an electron transporting moiety; X is selected from the group consisting of halide, cyano, alkoxy, acyloxy, and aryloxy; a, b, c, and d are mole fractions of the repeating monomer units such that the sum of a+b+c+d is equal to 1; R is alkyl, substituted alkyl, aryl, or substituted aryl; and $R^1$, $R^2$, and $R^3$ are independently selected from the group consisting of alkyl, aryl, alkoxy, aryloxy, acyloxy, halogen, cyano, and amino, subject to the provision that two of $R^1$, $R^2$, and $R^3$ are independently selected from the group consisting of alkoxy, aryloxy, acyloxy, and halide.

Illustrated in U.S. Pat. No. 5,473,064, the disclosure of which is totally incorporated herein by reference, is a process for the preparation of hydroxygallium phthalocyanine Type V, essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts $DI^3$, for each part of gallium chloride that is reacted; hydrolyzing the pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and preferably about 15 volume parts for each weight part of pigment hydroxygallium phthalocyanine that is used by, for example, ballmilling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

Illustrated in U.S. Pat. No. 5,521,043, the disclosure of which is totally incorporated herein by reference, are photoconductive imaging members comprised of a supporting substrate, a photogenerating layer of hydroxygallium phthalocyanine, a charge transport layer, a photogenerating layer of BZP perylene, which is preferably a mixture of bisbenzimidazo(2,1-a-1',2'-b)anthra(2,1,9-def:6,5,10-d'e'f')diisoquinoline-6,11 dione and bisbenzimidazo(2,1-a:2',1'-a)anthra(2,1,9-def:6,5,10-d'e'f')diisoquinoline-10,21-dione, reference U.S. Pat. No. 4,587,189, the disclosure of which is totally incorporated herein by reference; and as a top layer a second charge transport layer.

The appropriate components and processes of the above patents may be selected for the present invention in embodiments thereof.

BACKGROUND

This invention is generally directed to imaging members, and more specifically, the present invention is directed to photoconductive imaging members with a hole blocking, or undercoat layer (UCL) generated, for example, from a solution, particularly a homogenous solution, of a titanium alkyloxide, such as titanium isopropoxide, a triaminoalkyl alkoxy silane like 3-aminopropyl trimethoxysilane (APS), a polymer binder, such as poly(methyl methacrylate) (PMMA), vinyl chloride copolymer and poly(vinyl butyral) (PVB) thereof, and a suitable solvent like a ketone, such as methyl ethyl ketone, and an alcohol, such as 1-propanol, which solution in embodiments is transparent and wherein the solvent, the titanium compound and the silane can form, for example, titanates, such as ammonium titanates, in an acidic environment. More specifically, the hole blocking layer in contact with the supporting substrate can be situated between the supporting substrate and the photogenerating layer, which is comprised, for example, of the photogenerating pigments of U.S. Pat. No. 5,482,811, the disclosure of which is totally incorporated herein by reference, especially Type V hydroxygallium phthalocyanine, and generally metal free phthalocyanines, metal phthalocyanines, perylenes, titanyl phthalocyanines, seleniums, selenium alloys, azo pigments, squaraines, and the like. The imaging members of the present invention in embodiments exhibit excellent and stable electrical characteristics; cyclic/environmental stability, and substantially no adverse changes in their performance over extended time periods since, for example, the imaging members comprise a mechanically robust and solvent resistant hole blocking layer, enabling the coating of a subsequent photogenerating layer thereon without substantial structural damage; low and excellent $V_{low}$, that is the surface potential of the imaging member subsequent to a certain light exposure, and which $V_{low}$ is about 20 to about 75 volts lower than, for example, a comparable hole blocking layer of a titanium oxide/phenol resin/silicon oxide dopant, and which blocking layer can be easily coated on the supporting substrate by various coating techniques of, for example, dip or slot-coating. The photoresponsive, or photoconductive imaging members can be negatively charged when the photogenerating layers are situated between the hole transport layer and the hole blocking layer deposited on the substrate.

Processes of imaging, especially xerographic imaging, and printing, including digital, are also encompassed by the present disclosure. More specifically, the layered photoconductive imaging members of the present disclosure can be selected for a number of different known imaging and printing processes including, for example, electrophotographic imaging processes, especially xerographic imaging and printing processes wherein charged latent images are rendered visible with toner compositions of an appropriate charge polarity. The imaging members are in embodiments sensitive in the wavelength region of, for example, from about 500 to about 900 nanometers, and in particular from about 650 to about 850 nanometers, thus diode lasers can be selected as the light source. Moreover, the imaging members of this invention are useful in color xerographic applications, particularly high-speed color copying and printing processes.

REFERENCES

Layered photoresponsive imaging members have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound dispersed in an electrically insulating organic resin binder.

In U.S. Pat. No. 4,587,189, the disclosure of which is totally incorporated herein by reference, there is illustrated a layered imaging member with, for example, a perylene, pigment photogenerating component. The above components, such as the photogenerating compounds and the aryl amine charge transport, can be selected for the imaging members of the present invention in embodiments thereof.

In U.S. Pat. No. 4,921,769, the disclosure of which is totally incorporated herein by reference, there are illustrated photoconductive imaging members with blocking layers of certain polyurethanes.

Illustrated in U.S. Pat. Nos. 6,255,027; 6,177,219, and 6,156,468, the disclosures of which are totally incorporated herein by reference, are, for example, photoreceptors containing a hole blocking layer of a plurality of light scattering particles dispersed in a binder, reference for example, Example I of U.S. Pat. No. 6,156,468, the disclosure of which is totally incorporated herein by reference, wherein there is illustrated a hole blocking layer of titanium dioxide dispersed in a specific linear phenolic binder of VARCUM™, available from OxyChem Company.

SUMMARY

It is a feature of the present disclosure to provide imaging members with many of the advantages illustrated herein, such as substantially preventing, or minimizing dark injection, and wherein the resulting photoconducting members possess, for example, excellent photoinduced discharge characteristics, cyclic and environmental stability and acceptable charge deficient spot levels usually generated from dark injection of charge carriers.

Another feature of the present disclosure relates to the provision of layered photoresponsive imaging members, which are responsive to near infrared radiation of from about 700 to about 900 nanometers.

It is yet another feature of the present disclosure to provide layered photoresponsive imaging members with sensitivity to visible light.

Moreover, another feature of the present disclosure relates to the provision of layered photoresponsive imaging members with mechanically robust and solvent resistant hole blocking layers.

Moreover, in another feature of the present disclosure there is provided a hole blocking layer applied to a drum of, for example, aluminum.

Aspects of the present disclosure relate to a photoconductive imaging member comprised of a hole blocking layer, a photogenerating layer, and a charge transport layer, and wherein the hole blocking layer is generated from a solution of a metal alkyloxide, an amino alkylsilane, or an aminoalkyl alkoxy silane, a polymer binder, and an organic solvent; a photoconductive imaging member comprised of an optional supporting substrate, a hole blocking layer, a photogenerating layer, and a charge transport layer, and wherein the hole blocking layer is comprised of a titanium alkyloxide, an amino alkyl silane, and an optional polymer binder; a photoconductive imaging member comprised of a supporting substrate, a hole blocking layer, a photogenerating layer, and a charge transport layer, and wherein the hole blocking layer is comprised of titanium isopropoxide, or 3-aminopropyl trimethoxysilane, and the binder is poly (methyl methacrylate), poly(vinyl chloride-co-vinyl acetate-co-vinyl alcohol), or a poly(vinyl butyral); a photoconductive imaging member comprised of a supporting substrate, a hole blocking layer thereover, a photogenerating layer, and a charge transport layer; a photoconductive imaging member wherein the hole blocking layer is of a thickness of about 0.01 to about 30 microns, and more specifically, is of a thickness of about 0.1 to about 8 microns; a photoconductive imaging member comprised in sequence of a supporting substrate, a hole blocking layer, an optional adhesive layer, a photogenerating layer and a charge transport layer; a photoconductive imaging member wherein the supporting substrate is comprised of a conductive metal substrate; a photoconductive imaging member wherein the conductive substrate is aluminum, aluminized polyethylene terephthalate or titanized polyethylene; a photoconductive imaging member wherein the photogenerator layer is of a thickness of from about 0.05 to about 10 microns; a photoconductive imaging member wherein the charge, such as hole transport layer, is of a thickness of from about 10 to about 50 microns; a photoconductive imaging member wherein the photogenerating layer is comprised of photogenerating pigments dispersed in a resinous binder in an amount of from about 5 percent by weight to about 95 percent by weight; a photoconductive imaging member wherein the photogenerating resinous binder is selected from the group consisting of copolymers of vinyl chloride, vinyl acetate and hydroxy and/or acid containing monomers, polyesters, polyvinyl butyrals, polycarbonates, polystyrene-b-polyvinyl pyridine, and polyvinyl formals; a photoconductive imaging member wherein the charge transport layer comprises aryl amine molecules, and wherein the aryl amine is dispersed in a resinous binder; a photoconductive imaging member wherein the aryl amine is dispersed in a resinous binder selected from the group consisting of polycarbonates and polystyrene; a photoconductive imaging member wherein the aryl amine is N,N'-diphenyl-N,N-bis(3-methyl phenyl)-1,1'-biphenyl-4,4'-diamine; a photoconductive imaging member wherein the photogenerating layer is comprised of metal phthalocyanines, or metal free phthalocyanines; a photoconductive imaging member wherein the photogenerating layer is comprised of titanyl phthalocyanines, perylenes, alkylhydroxygallium phthalocyanines, hydroxygallium phthalocyanines, or a mixture thereof; a photoconductive imaging member wherein the photogenerating layer is comprised of Type V hydroxygallium phthalocyanine; a method of imaging which comprises generating an electrostatic latent image on the imaging member illustrated herein, developing the latent image, and transferring the developed electrostatic image to a suitable substrate; an imaging member wherein there is selected for the blocking layer about 5 to about 95 weight percent of the titanium isopropoxide, about 5 to about 95 weight percent of the 3-aminopropyl trimethoxysilane, and about 20 to 80 percent of the polymer binder poly(vinyl butyral); an imaging member comprised in the sequence of a supporting substrate, a hole blocking layer, an adhesive layer, a photogenerating layer, and a hole transport layer; an imaging member wherein the adhesive layer is comprised of a polyester with an $M_w$ of about 40,000 to about 75,000, and an $M_n$ of from about 30,000 to about 45,000; an imaging member further containing a supporting substrate comprised of a conductive metal substrate of aluminum, aluminized polyethylene terephthalate or titanized polyethylene terephthalate; an imaging member wherein the photogenerator layer is of a thickness of from about 0.05 to about 10 microns, and wherein the transport layer is of a thickness of from about 10 to about 55 microns; an imaging member wherein the photogenerating layer is comprised of photogenerating pigments dispersed in a resinous binder in an amount of from about 5 percent by weight to about 95 percent by weight, and optionally wherein the resinous binder is selected from the group comprised of vinyl chloride/vinyl acetate copolymers, polyesters, polyvinyl butyrals, polycarbonates, polystyrene-b-polyvinyl pyridine, and polyvinyl formals; an imaging member wherein the charge transport layer comprises suitable known or future developed components, and more specifically, aryl amines, and which aryl amines are of the formula

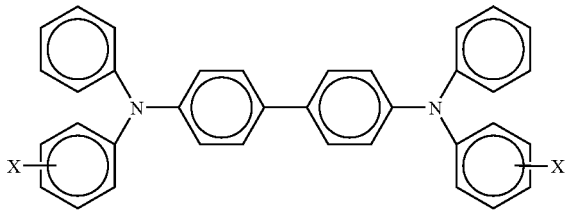

wherein X is selected from the group consisting of alkyl and halogen, and the like, and wherein the aryl amine is optionally dispersed in a resinous binder; an imaging member wherein alkyl contains from about 1 to about 10 carbon atoms; an imaging member wherein the aryl amine is N,N'-diphenyl-N,N-bis(3-methyl phenyl)-1,1'-biphenyl-4,4'-diamine; an imaging member wherein the photogenerating layer is comprised of metal phthalocyanines, or metal free phthalocyanines; an imaging member wherein the photogenerating layer is comprised of titanyl phthalocyanines, perylenes, or hydroxygallium phthalocyanines; an imaging member wherein the photogenerating layer is comprised of Type V hydroxygallium phthalocyanine; and a method of imaging which comprises generating an electrostatic latent image on the imaging member illustrated herein, developing the latent image with a known toner, and transferring the developed electrostatic image to a suitable substrate like paper.

Examples of components in the hole blocking layer are a metal alkyloxide, such as a metal propoxide like titanium isopropoxide (TIP), zirconium isopropoxide, titanium methoxide, titanium butoxide, zirconium butoxide titanium ethoxide, and the like; a silane, such as an alkylalkoxysilane like 3-aminopropyltrimethoxysilane (APS), 3-aminopropyltriethoxysilane, 3-aminopropyl diisopropylethoxysilane, 3-aminopropylmethyl diethoxysilane or 3-aminopropylpentamethyldisiloxane, and the like, such as an aminophenyltrimethoxysilane; a polymer of PMMA, PVB, and mixtures thereof polyvinyl alcohol, poly(hydroxyethyl methacrylate), poly(hydroxypropyl acrylate) and poly(vinylpyrrolidone); a copolymer like a vinyl halide, especially a vinyl chloride copolymer like poly(vinyl chloride-co-vinyl acetate), poly (vinyl chloride-co-vinyl acetate-co-vinyl alcohol), poly(vinylidene chloride-co-methyl acrylate) or poly(vinyl chloride-co-isobutyl vinyl ether), and the like, and wherein the solvent selected for the coating solution is a suitable organic solvent like MEK, THF, toluene, an alcohol like 1-propanol, ethanol, 1-butanol, and acetone. In embodiments, the amounts of components present in the final composition can be, for example, metal alkyloxide, such as titanium isopropoxide, of from about 5 percent to about 95, and more specifically, from about 20 percent to about 80 percent; the silane, such as 3-aminopropyltrimethoxysilane, of from about 95 percent to about 5 percent, and more specifically, from about 80 percent to about 20 percent; the binder polymer, such as PVB, of from about 1 percent to about 99 percent, and more specifically, from about 5 percent to about 70 percent; the solvent to, for example, control the viscosity of the coating solution of from about 5 to about 95 weight percent, and more specifically, from about 15 to about 80 percent.

Illustrative examples of substrate layers selected for the imaging members of the present invention, and which substrates may be know substrates and which can be opaque or substantially transparent, comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass or the like. The substrate may be flexible, seamless, or rigid, and may have a number of many different configurations, such as for example, a plate, a cylindrical drum, a scroll, an endless flexible belt, and the like. In one embodiment, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The thickness of the substrate layer depends on a number of factors, including the characteristics desired and economical considerations, thus this layer may be of substantial thickness, for example over 3,000 microns, such as from about 3,000 to about 7,000 or of minimum thickness, such as at least about 50 microns, providing there are no significant adverse effects on the member. In embodiments, the thickness of this layer is from about 75 microns to about 300 microns.

The photogenerating layer, which can, for example, be comprised of hydroxygallium phthalocyanine Type V, is in embodiments comprised of, for example, about 60 weight percent of Type V and about 40 weight percent of a resin binder like copolymer of [vinylchloride/vinylacetate] such as VMCH (available from Dow Chemical). The photogenerating layer can contain known photogenerating pigments, such as metal phthalocyanines, metal free phthalocyanines, vanadyl phthalocyanines, alkylhydroxyl gallium phthalocyanine, hydroxygallium phthalocyanines, perylenes, especially bis(benzimidazo)perylene, titanyl phthalocyanines, and the like, and more specifically, vanadyl phthalocyanines, Type V hydroxygallium phthalocyanines, and inorganic components such as selenium, selenium alloys like selenium, and trigonal selenium. The photogenerating pigment can be dispersed in a resin binder similar to the resin binders selected for the charge transport layer, or alternatively no resin binder is present. Generally, the thickness of the photogenerator layer depends on a number of factors, including the thicknesses of the other layers and the amount of photogenerator material contained in the photogenerating layers. Accordingly, this layer can be of a thickness of, for example, from about 0.05 micron to about 10 microns, and more specifically, from about 0.25 micron to about 2 microns when, for example, the photogenerator compositions are present in an amount of from about 30 to about 75 percent by volume. The maximum thickness of this layer in embodiments is dependent primarily upon factors, such as photosensitivity, electrical properties and mechanical considerations. The photogenerating layer binder resin present in various suitable amounts, for example from about 1 to about 50, and more specifically, from about 1 to about 10 weight percent, may be selected from a number of known polymers such as poly(vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of solvents that can be selected for use as coating solvents for the photogenerator layers are ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, 1-butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The coating of the photogenerator layers in embodiments of the present invention can be accomplished with spray, dip or wire-bar methods such that the final dry thickness of the photogenerator layer is, for example, from about 0.01 to about 30 microns, and more specifically, from about 0.1 to about 15 microns after being dried at, for example, about 40° C. to about 150° C. for about 15 to about 90 minutes.

Illustrative examples of polymeric binder materials that can be selected for the photogenerator layer are as indicated herein, and include those polymers as disclosed in U.S. Pat. No. 3,121,006, the disclosure of which is totally incorporated herein by reference. In general, the effective amount of polymer binder that is utilized in the photogenerator layer ranges from about 0 to about 95 percent by weight, and preferably from about 25 to about 60 percent by weight of the photogenerator layer.

As optional adhesive layers usually in contact with the hole blocking layer, there can be selected various known substances inclusive of polyesters, polyamides, poly(vinyl butyral), poly(vinyl alcohol), polyurethane and polyacrylonitrile. This layer is, for example, of a thickness of from about 0.001 micron to about 1 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present invention further desirable electrical and optical properties.

Aryl amines selected for the charge, especially hole transporting layers, which generally is of a thickness of from about 5 microns to about 90 microns, and more specifically, of a thickness of from about 10 microns to about 45 microns, include molecules of the following formula

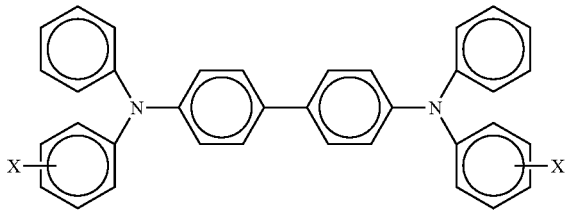

dispersed in a binder, such as a highly insulating and transparent polymer binder, wherein X is, for example, alkyl, and which alkyl contains, for example, from about 1 to about 20 carbon atoms, a halogen like chloride, or mixtures thereof, especially those substituents selected from the group consisting of Cl and $CH_3$.

Examples of specific aryl amines are N,N'-diphenyl-N,N'-bis(alkylphenyl)-1,1'-biphenyl-4,4'-diamine wherein alkyl is selected from the group consisting of methyl, ethyl, propyl, butyl, hexyl, and the like; and N,N'-diphenyl-N,N'-bis(halophenyl)-1,1'-biphenyl-4,4'-diamine wherein the halo substituent is preferably a chloro substituent. Other known charge transport layer molecules can be selected, reference for example, U.S. Pat. Nos. 4,921,773 and 4,464,450, the disclosures of which are totally incorporated herein by reference.

Examples of the binder materials for the transport layer include components, such as those described in U.S. Pat. No. 3,121,006, the disclosure of which is totally incorporated herein by reference. Specific examples of polymer binder materials include polycarbonates, acrylate polymers, vinyl polymers, cellulose polymers, polyesters, polysiloxanes, polyamides, polyurethanes, poly(cyclo olefins), and epoxies as well as block, random or alternating copolymers thereof. Preferred electrically inactive binders are comprised of polycarbonate resins with a molecular weight of from about 20,000 to about 100,000 with a molecular weight $M_w$ of from about 50,000 to about 100,000 being particularly preferred. Generally, the transport layer contains from about 10 to about 75 percent by weight of the charge transport material, and more specifically, from about 35 percent to about 50 percent of this material.

Also included within the scope of the present invention are methods of imaging and printing with the photoresponsive devices illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same steps with the exception that the exposure step can be accomplished with a laser device or image bar.

The following Examples are being submitted to illustrate embodiments of the present invention. These Examples are intended to be illustrative only and are not intended to limit the scope of the present invention. Also, parts and percentages are by weight unless otherwise indicated. Comparative Examples and data are also provided.

EXAMPLE I

A homogeneous solution for the imaging member undercoat layer or hole blocking layer was prepared by dissolving 4 grams of titanium isopropoxide and 4 grams of 3-aminopropyltrimethoxysilane in 20 grams of 1 propanol. A 30 millimeters in diameter and 340 millimeters in length aluminum pipe cleaned with detergent and rinsed with deionized water was dip coated with the above prepared coating dispersion at a pull rate of 300 millimeters/minute, and subsequently dried at 160° C. for 30 minutes, which resulted in an undercoat layer (UCL) with a thickness of 7.3 microns. Additional similar devices with the UCL thicknesses at 8.5 and 15 microns were also fabricated by repeating the above process.

A 0.5 micron thick photogenerating layer was subsequently coated on top of the above generated undercoat layer from a dispersion of Type V hydroxygallium phthalocyanine (2.4 grams), alkylhydroxy gallium phthalocyanine (0.6 gram), and a vinyl chloride/vinyl acetate copolymer, VMCH ($M_n$=27,000, about 86 weight percent of vinyl chloride, about 13 weight percent of vinyl acetate, and about 1 weight percent of maleic acid) available from Dow Chemical (2 grams) in 95 grams of n-butylacetate. Subsequently, a 24 μm charge transport layer (CTL) was coated on top of the photogenerating layer from a solution of N,N'-diphenyl-N,N-bis(3-methyl phenyl)-1,1'-biphenyl-4,4'-diamine (8.8 grams) and a polycarbonate, PCZ-400 poly(4,4'-dihydroxydiphenyl-1-1-cyclohexane, $M_w$=40,000, available from Mitsubishi Gas Chemical Company, Ltd. (13.2 grams) in a mixture of 55 grams of tetrahydrofuran (THF) and 23.5 grams of toluene. The CTL was dried at 120° C. for 45 minutes.

The above devices were electrically tested with an electrical scanner set to obtain photoinduced discharge cycles, sequenced at one charge-erase cycle followed by one charge-expose-erase cycle, wherein the light intensity was incrementally increased with cycling to produce a series of photoinduced discharge characteristics curves from which the photosensitivity and surface potentials at various exposure intensities were measured. Additional electrical characteristics were obtained by a series of charge-erase cycles with incrementing surface potential to generate several voltage versus charge density curves. The scanner was equipped with a scorotron set to a constant voltage charging at various surface potentials. The devices were tested at surface potentials of 500 and 700 volts with the exposure light intensity incrementally increased by means of regulating a series of neutral density filters; the exposure light source was a 780 nanometer light emitting diode. The aluminum drum was rotated at a speed of 55 revolutions per minute to produce a surface speed of 277 millimeters per second or a cycle time of 1.09 seconds. The xerographic simulation was completed in an environmentally controlled light tight chamber at ambient conditions (40 percent relative humidity and 22° C.). Two photoinduced discharge characteristic (PIDC) curves were obtained from the two different pre-exposed surface potentials, and the data was interpolated into PIDC curves at an initial surface potential of 600 volts. The following table summarizes the electrical performance for these devices.

| UCL Thickness of the Device | $V_{low}$ of 2.6 erg/cm$^2$ Exposure Energy (V) | $V_{low}$ of 4.26 erg/cm$^2$ Exposure Energy (V) | dV/dx | $V_{depletion}$ (V) |
|---|---|---|---|---|
| 7.3 μm | 176 | 57 | 159 | 47 |
| 8.5 μm | 163 | 45 | 166 | 58 |
| 15.0 μm | 209 | 107 | 142 | 12 |

$V_{low}$ is the surface potential of the device subsequent to a certain light exposure at a certain time delay after the exposure, dV/dx is the initial slope of the PIDC curve and is a measurement of sensitivity, and $V_{depletion}$ is linearly extrapolated from the surface potential versus charge density relation of the device, and is a measurement of voltage leakage during charging. In general, a lower $V_{low}$, a higher dV/, and a lower $V_{depletion}$ yields a device with excellent electrical characteristics.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. A photoconductive imaging member comprised of a hole blocking layer, a photogenerating layer, and a charge transport layer, wherein the hole blocking layer is generated from a solution of a titanium alkyloxide, a polymer binder, and an organic solvent, and a silane selected from the group consisting of amino alkylsilane, aminoalkoxy silane and aminoalkyl alkoxy silane.

2. A photoconductive imaging member in accordance with claim 1 wherein said metal alkyloxide is a titanium isopropoxide of the formula:

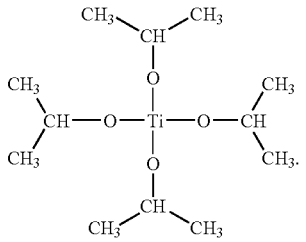

3. A photoconductive imaging member in accordance with claim 1 wherein said titanium alkyloxide is titanium methoxide, titanium butoxide, or titanium ethoxide.

4. A photoconductive imaging member in accordance with claim 1 wherein said silane is a trimethoxysilane, said binder is a vinyl halide, and said solvent is a ketone, or an alcohol.

5. A photoconductive imaging member in accordance with claim 1 wherein said silane is 3-aminopropyl trimethoxysilane, said titanium alkyloxide is titanium isopropoxide, said solvent is a ketone, and said binder is a vinyl polymer of poly(vinyl chloride-co-vinyl acetate), poly(vinyl chloride-co-vinyl acetate-co-vinyl alcohol), poly(vinylidene chloride-co-methyl acrylate) or poly(vinyl chloride-co-isobutyl vinyl ether).

6. A photoconductive imaging member in accordance with claim 1 wherein said silane is

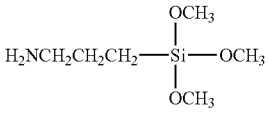

and said silane is present in an amount of from about 5 to about 95 weight percent, said titanium alkyloxide is present in an amount of from about 95 to about 5 weight percent, and about 5 to about 95 percent of said polymer binder is present.

7. A photoconductive imaging member in accordance with claim 1 wherein there is present from about 20 to about 80 weight percent of said titanium alkyloxide, about 80 to about 20 weight percent of said silane of 3-aminoalkyl silane, and about 15 to about 80 percent of said binder.

8. A photoconductive imaging member in accordance with claim 1 wherein said solvent is methyl ethyl ketone.

9. A method of imaging which comprises generating an electrostatic latent image on the imaging member of claim 1, developing the latent image, and transferring the developed electrostatic image to a suitable substrate.

10. A photoconductive imaging member in accordance with claim 1 wherein the hole blocking layer is generated from a solution of a metal alkyloxide, an aminoalkyl alkoxy silane, a polymer binder of a poly(methyl methacrylate) or a vinyl chloride copolymer, and said organic solvent.

11. A photoconductive imaging member comprised of an optional supporting substrate, a hole blocking layer, a photogenerating layer, and a charge transport layer, and wherein the hole blocking layer is comprised of a titanium alkyloxide, an amino silane, and an optional polymer binder.

12. A photoconductive imaging member in accordance with claim 1 wherein said alkyloxide is a propoxide.

13. A photoconductive imaging member in accordance with claim 11 wherein said titanium alkyloxide is a titanium isopropoxide of the formula

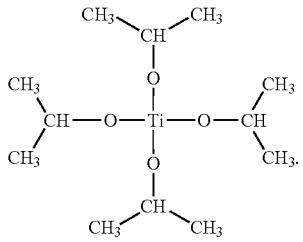

14. A photoconductive imaging member in accordance with claim 11 wherein said titanium alkyloxide is titanium methoxide, titanium butoxide, or titanium ethoxide.

15. A photoconductive imaging member in accordance with claim 11 wherein said silane is a trimethoxysilane, and optionally wherein said binder is a vinyl halide.

16. A photoconductive imaging member in accordance with claim 11 wherein said silane is 3-aminopropyl trimethoxysilane, said titanium alkyloxide is titanium isopropoxide, and said binder is a vinyl polymer of poly(vinyl chloride-co-vinyl acetate-co-vinyl alcohol).

17. A photoconductive imaging member in accordance with claim 11 wherein there is present from about 5 to about 95 weight percent of said titanium alkyloxide, about 95 to about 5 weight percent of said silane, and about 5 to about 95 percent of said binder.

18. A photoconductive imaging member in accordance with claim 11 wherein there is present about 20 to about 80 weight percent of said titanium alkyloxide, about 80 to about 20 weight percent of said silane of an aminoalkyl alkoxy silane, and about 15 to about 80 percent of said binder.

19. A photoconductive imaging member in accordance with claim 11 wherein said hole blocking layer is of a thickness of from about 0.01 to about 30 microns.

20. A photoconductive imaging member in accordance with claim 11 wherein said hole blocking layer is of a thickness of from about 0.1 to about 8 microns.

21. A photoconductive imaging member in accordance with claim 11 comprised in the following sequence of a supporting substrate, said hole blocking layer, an optional adhesive layer, said photogenerating layer, and said charge transport layer, and wherein the charge transport layer is a hole transport layer.

22. A photoconductive imaging member in accordance with claim 21 wherein the adhesive layer is present and is comprised of a polyester with an $M_w$ of about 45,000 to about 75,000, and an $M_n$ of from about 30,000 to about 40,000.

23. A photoconductive imaging member in accordance with claim 11 containing a supporting substrate comprised of a conductive metal substrate of aluminum, aluminized polyethylene terephthalate or titanized polyethylene terephthalate.

24. A photoconductive imaging member in accordance with claim 11 wherein said photogenerator layer is of a thickness of from about 0.05 to about 10 microns, and wherein said transport layer is of a thickness of from about 10 to about 50 microns.

25. A photoconductive imaging member in accordance with claim 11 wherein said photogenerating layer is comprised of a photogenerating pigment or photogenerating pigments dispersed in a resinous binder, and wherein said pigment or pigments are present in an amount of from about 5 percent by weight to about 95 percent by weight, and optionally wherein said binder is selected from the group comprised of vinyl chloride/vinyl acetate copolymers, polyesters, polyvinyl butyrals, polycarbonates, polystyrene-b-polyvinyl pyridine, and polyvinyl formals.

26. A photoconductive imaging member in accordance with claim 11 wherein said charge transport layer comprises aryl amines, and which aryl amines are of the formula

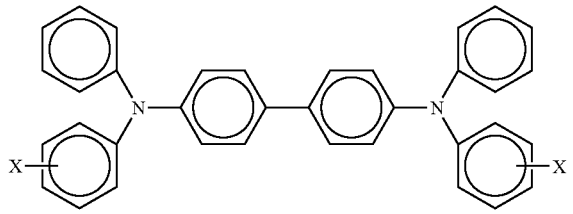

wherein X is selected from the group consisting of alkyl, alkoxy and halogen.

27. A photoconductive imaging member in accordance with claim 26 wherein said aryl amine is N,N'-diphenyl-N,N'-bis(3-methyl phenyl)-1,1'-biphenyl-4,4'-diamine.

28. A photoconductive imaging member in accordance with claim 11 wherein the photogenerating layer is comprised of metal phthalocyanines, or metal free phthalocyanines.

29. A photoconductive imaging member in accordance with claim 11 wherein the photogenerating layer is comprised of titanyl phthalocyanines, perylenes, or hydroxygallium phthalocyanines.

30. A photoconductive imaging member in accordance with claim 11 wherein the photogenerating layer is comprised of Type V hydroxygallium phthalocyanine.

31. A photoconductive imaging member comprised of a supporting substrate, a hole blocking layer, a photogenerating layer, and a charge transport layer, wherein the hole blocking layer is comprised of titanium isopropoxide, 3-aminopropyl trimethoxysilane, and a polymer binder;

wherein said binder is poly(methyl methacrylate), poly (vinyl chloride-co-vinyl acetate-co-vinyl alcohol), or a poly(vinyl butyral);

and wherein the hole blocking layer has a thickness of from about 15 to about 30 microns.

* * * * *